US007909363B2

(12) United States Patent
Anderson

(10) Patent No.: US 7,909,363 B2
(45) Date of Patent: Mar. 22, 2011

(54) DESTRUCTIVELY REMOVABLE BARCODE

(75) Inventor: Neal Anderson, Edina, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 12/143,368

(22) Filed: Jun. 20, 2008

(65) Prior Publication Data

US 2009/0315317 A1 Dec. 24, 2009

(51) Int. Cl.
*B42D 15/00* (2006.01)

(52) U.S. Cl. ..... 283/81; 283/98; 283/99; 283/100; 283/101; 283/103; 283/105; 283/107

(58) Field of Classification Search ..... 53/425; 156/69, 268, 277; 215/232, 247, 249, 251, 215/254; 220/270; 229/87.05; 283/81, 98, 283/99, 100, 101, 103, 105, 900, 9 R, 104, 283/107, 109 R; 383/5, 42, 66, 203, 205; 422/1, 73, 99, 100, 102, 104; 428/43, 916; 436/69, 70; *B01L 3/00; B32B 31/18; B42D 15/00; B65D 33/00, 33/16, 65/26*
See application file for complete search history.

(56) References Cited

U.S. PATENT DOCUMENTS

| | | | | |
|---|---|---|---|---|
| 3,631,617 | A | 1/1972 | Pekko | 40/2.2 |
| 3,982,744 | A * | 9/1976 | Kraynak et al. | 270/12 |
| 4,082,873 | A * | 4/1978 | Williams | 283/108 |
| 4,514,248 | A | 4/1985 | Cummings | 156/268 |
| 4,787,158 | A | 11/1988 | Vitol | 40/638 |
| 5,084,143 | A | 1/1992 | Smith | 205/112 |
| 5,484,996 | A * | 1/1996 | Wood | 235/487 |
| 5,893,587 | A | 4/1999 | Wong | 283/98 |
| 5,895,075 | A | 4/1999 | Edwards | 283/81 |
| 5,900,610 | A | 5/1999 | Kelly, Jr. | 235/385 |
| 6,457,747 | B1 | 10/2002 | Treleaven et al. | 283/81 |
| 7,052,055 | B1 | 5/2006 | Castro Netto | 292/307 |
| 7,122,157 | B2 | 10/2006 | Stevens et al. | 422/102 |
| 7,166,345 | B2 | 1/2007 | Myers et al. | 428/42.3 |
| 2003/0020274 | A1 * | 1/2003 | Milliorn | 283/81 |
| 2003/0211273 | A1 | 11/2003 | Perry et al. | 428/41.8 |
| 2004/0056477 | A1 | 3/2004 | Bruce | 283/81 |
| 2004/0124629 | A1 * | 7/2004 | Davis et al. | 283/81 |
| 2006/0147129 | A1 * | 7/2006 | Miller | 383/205 |

* cited by examiner

*Primary Examiner* — Dana Ross
*Assistant Examiner* — Justin V Lewis
(74) *Attorney, Agent, or Firm* — Theodore M. Magee; Westman, Champlin & Kelly, P.A.

(57) ABSTRACT

A label is provided having three parts separated by separation lines. Two of the three parts have pull tabs to allow them to be easily removed. The third part is a narrow strip between the separation lines that does not have a pull tab. When the label parts that have pull tabs are lifted off a product, the label separates at the separation lines, leaving the third narrow strip on the product. This narrow strip is then removed with a scraping action that tends to destroy the narrow strip. This makes it difficult to reconstruct the label after it has been removed from a product. In other embodiments, the label has two parts made of material that stretches when the parts are removed from a product. The stretching distorts a barcode graphic printed on the label making the barcode unreadable.

19 Claims, 6 Drawing Sheets

DESTRUCTIVELY REMOVABLE BARCODE

BACKGROUND

In retail environments, barcode labels are used on products to encode the identity of the products in black and white patterns that can be read by a scanner.

For products that are not surrounded by packaging, the barcode labels are often applied directly to the product using an adhesive. After purchase, consumers typically remove such labels because they mar the appearance of the products. If the label is too difficult to remove, the consumer is less satisfied with their purchase.

However, if the label is too easy to remove, the label becomes susceptible to label switching in which a person switches a label for a higher cost item with the label for a lower cost item. Thus, it is desirable to make the label easy to remove while making label switching difficult.

The discussion above is merely provided for general background information and is not intended to be used as an aid in determining the scope of the claimed subject matter.

SUMMARY

A label is provided having three parts separated by separation lines. Two of the three parts have pull tabs to allow them to be easily removed. The third part is a narrow strip between the separation lines that does not have a pull tab. When the label parts that have pull tabs are lifted off a product, the label separates at the separation lines, leaving the third narrow strip on the product. This narrow strip is then removed with a scraping action that tends to destroy the narrow strip. This makes it difficult to reconstruct the label after it has been removed from a product. In other embodiments, the label has two parts made of material that stretches when the parts are removed from a product. The stretching distorts a barcode graphic printed on the label making the barcode unreadable.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In the embodiments described herein, a label is provided that consists of three parts. The three parts are separated by separation lines such as a scored line or a partially cut line. Two of the parts of the label include pull tabs having edges that are aligned with the separation lines and that assist the user in removing the two parts of the label. The third part is a narrow strip that extends between the two separation lines. When attempting to remove the label from a product, it is very difficult to keep the label in one piece because the label easily separates along the separation lines. Further, it is difficult to remove the narrow strip between the two separation lines without damaging the narrow strip. As a result, it is difficult to reconstruct the label after its removal from a product. This makes it difficult to switch the label from one product to another product.

In many embodiments, a barcode is printed across the three sections of the label such that one section of the barcode is only printed on the narrow strip between the two separation lines. As a result, if the narrow strip is damaged during removal, the complete barcode cannot be reconstructed simply by using the two larger portions of the label.

In another embodiment, the label comprises two parts and is formed of an elastic material. When either part of the label is removed, the elastic nature of the label causes the barcode printed on the label to distort and become unreadable.

Figure 1:
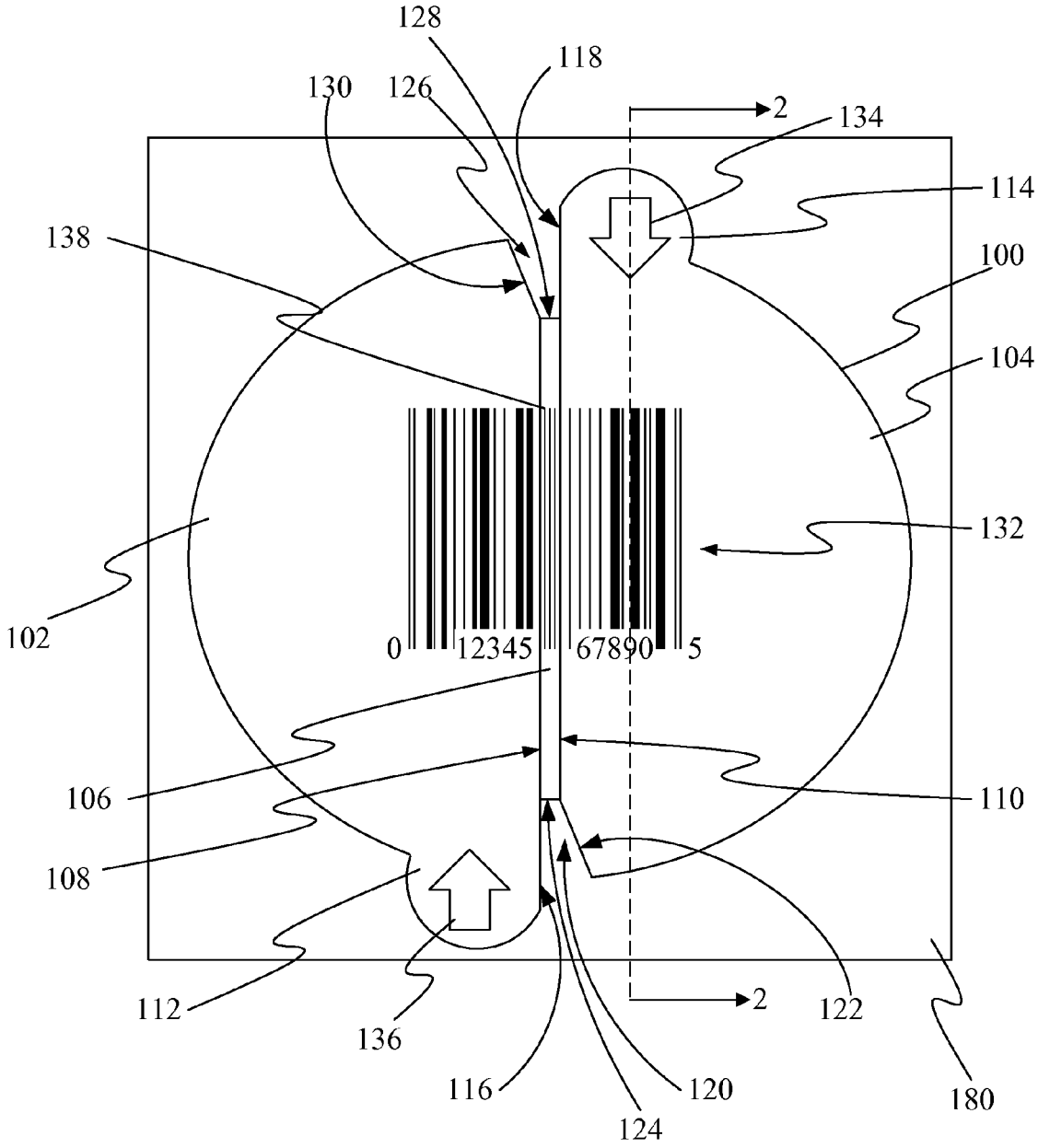
FIG. 1 is a top view of a label under one embodiment.

FIG. 1 provides a top view of a label 100 under one embodiment that is applied to a product 180. Label 100 includes a first part or section 102, a second part or section 104 and a third part or section 106. First part 102 is separated from third part 106 by weakened area shown as a separation line 108. Second part 104 is separated from third part 106 by weakened area shown as separation line 110. Separation lines 108 and 110 can be formed by scoring label 100, cutting a top part of label 100 and/or by perforating label 100. In each of these cases, the separation lines can be said to be partially cut lines.

Although separation lines 108 and 110 are shown as being parallel in FIG. 1, this is not required. In many embodiments, however, the distance between separation lines 108 and 110 across third part 106 should be less than 2 millimeters along at least one portion of third part 106, where the distance between any one point on line 108 and line 110 is the shortest distance from the point on line 108 to any point on line 110. In addition, although lines 108 and 110 are shown as single straight lines in FIG. 1, in other embodiments, lines 108 and 110 may be curved and/or jagged.

First part 102 of label 100 includes a pull tab or lifting tab 112 and second part 104 includes a pull tab or lifting tab 114. Pull tabs 112 and 114 are gripping pieces that are provided to make it easier for users to grip the label during removal. Under one embodiment, pull tab 112 is defined in part by an edge 116 of label 100 that is aligned with and extends from separation line 108. Similarly, pull tab 114 is partially defined by an edge 118 of label 100 that is aligned with and extends from separation line 110. A recess 120 is defined in label 100 by edge 116, an edge 122 that defines part of second part 104 and an edge 124 that defines part of third part 106. Similarly, a recess 126 is defined in label 100 by edge 118, an edge 128 that defines part of third part 106 and an edge 130 that defines part of first part 102. Separation lines 108 and 110 extend from recess 126 to recess 120.

Graphical material, such as barcode graphic 132 and/or arrow graphics 134 and 136, is printed on the top of label 100. Barcode graphic 132 extends across first part 102, third part 106 and second part 104 of label 100. Under one embodiment, barcode graphic 132 includes at least one dark element, such as dark element 138, that is shown in its entirety within third part 106. As a result, if third part 106 is damaged during removal of label 100, the information represented by dark element 138 will be lost. As a result, if only first part 102 and second part 104 are placed on another item, the barcode information will not read properly.

Arrows 134 and 136 provide an indication to a user that pull tabs 112 and 114 should be pulled in a direction that is parallel to separation lines 108 and 110. If pull tabs 112 and 114 are lifted in such a direction, first part 102 and second part 104 will separate from third part 106 easily along separation lines 108 and 110 thereby facilitating quick removal of label 100.

Figure 2:
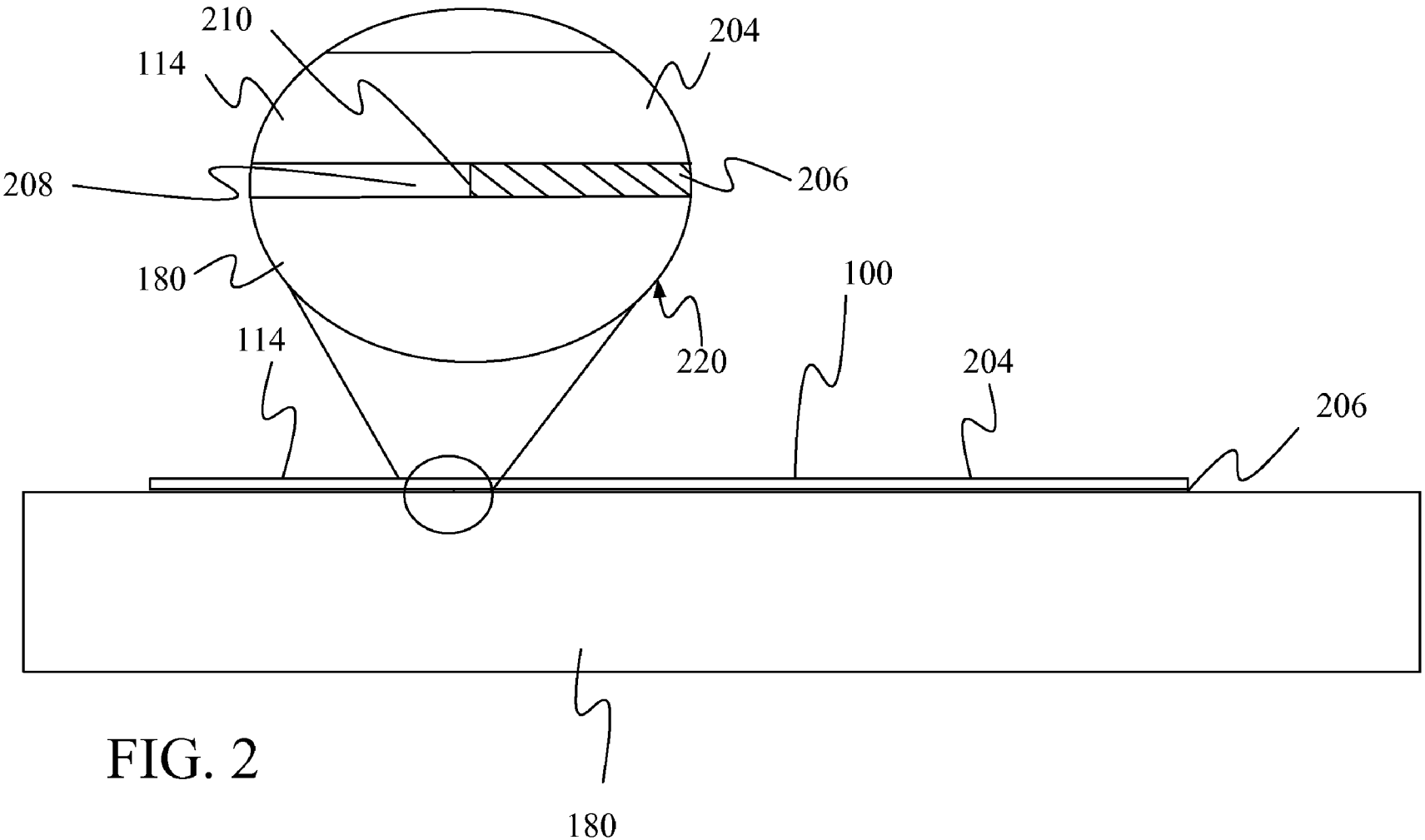
FIG. 2 is a cross sectional view of the label and product of FIG. 1.

FIG. 2 shows a cross-section of label 100 and product 180 taken along line 2-2 of FIG. 1. As shown in FIG. 2, label 100 consists of plastic sheet layer 204 and adhesive layer 206. Further, in the embodiment of FIG. 2, adhesive layer 206 has been selectively applied to plastic layer 204 such that there is no adhesive present between pull tab 114 and product 180. This can be seen more clearly in the magnified region 220, where adhesive layer 206 ends at an adhesive edge 210, leaving an area 208 that does not have an adhesive layer. Although pull tab 114 is shown as not contacting product 180 in FIG. 2, in other embodiments, pull tab 114 is in contact with product 180 when there is no adhesive layer between pull tab 114 and product 180. By not placing adhesive beneath pull tab 114, it is easier for consumers to lift pull tab 114 and begin removing label 100 from product 180. In other embodiments, adhesive layer 206 extends beneath the entirety of label 100 including pull tab 114.

Figure 3:
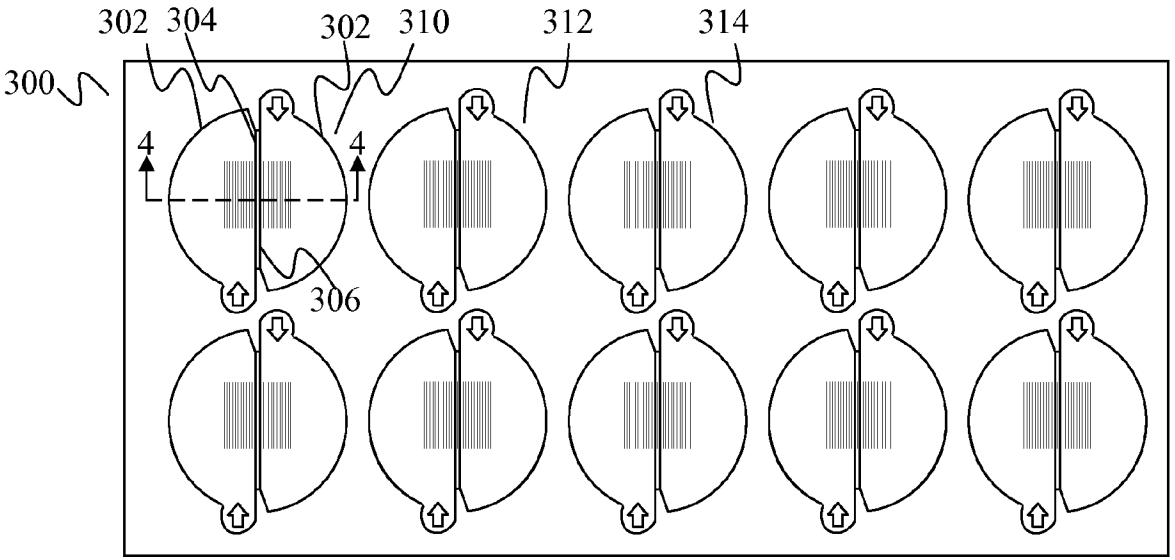
FIG. 3 is a top view of a laminate material containing a plurality of labels.
Figure 4:
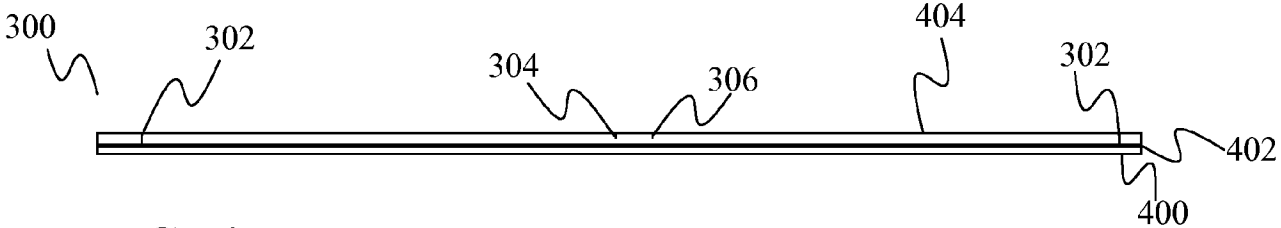
FIG. 4 is a cross sectional view of the laminate material of FIG. 3.

FIG. 3 provides a top view of a laminate sheet 300 on which a plurality of labels, such as labels 310, 312, and 314, have been formed. FIG. 4 provides a cross sectional view of a portion of laminate sheet 300 along lines 4-4.

As shown in FIG. 4, laminate sheet 300 includes a backing layer 400, an adhesive layer 402 and a plastic sheet layer 404. In the illustrated embodiment, adhesive layer 402 and plastic sheet layer 404 are the same as adhesive layer 206 and plastic sheet layer 204 of FIG. 2. Plastic sheet layer 404 can be formed of any known plastic sheet material such as polyethylene, polypropylene, polyester, polyethylene terephthalate (PET), high density polyethylene (HDPE), low density polyethylene (LDPE), linear low density polyethylene (LLDPE), oriented polypropylene (OPP), polystyrene, or polyvinyl chloride (PVC), for example. In other embodiments, plastic sheet layer 404 can be replaced with paper. Adhesive layer 402 is a non-permanent adhesive such as a pressure sensitive adhesive, or a water moistenable gummed adhesive. The adhesive should be strong enough to keep label 100 on the product until the consumer deliberately attempts to remove the label but should not be so strong that removing the label is difficult for the consumer. Backing layer 400 is a plastic or paper layer preferably coated with silicon so that adhesive layer 402 releases easily from backing layer 400.

In FIGS. 3 and 4, the exterior edges of a label, such as exterior edges 302 are formed by cutting through the entirety of plastic sheet layer 404. Separation lines such as separation lines 304 and 306 are formed either by scoring plastic sheet 404, cutting through less than the full depth of sheet material 404, and/or by perforating plastic sheet material 404. In FIG. 4, separation lines 304 and 306 are shown as being formed by cutting through less than the entire depth of plastic sheet material 404.

Figure 5:
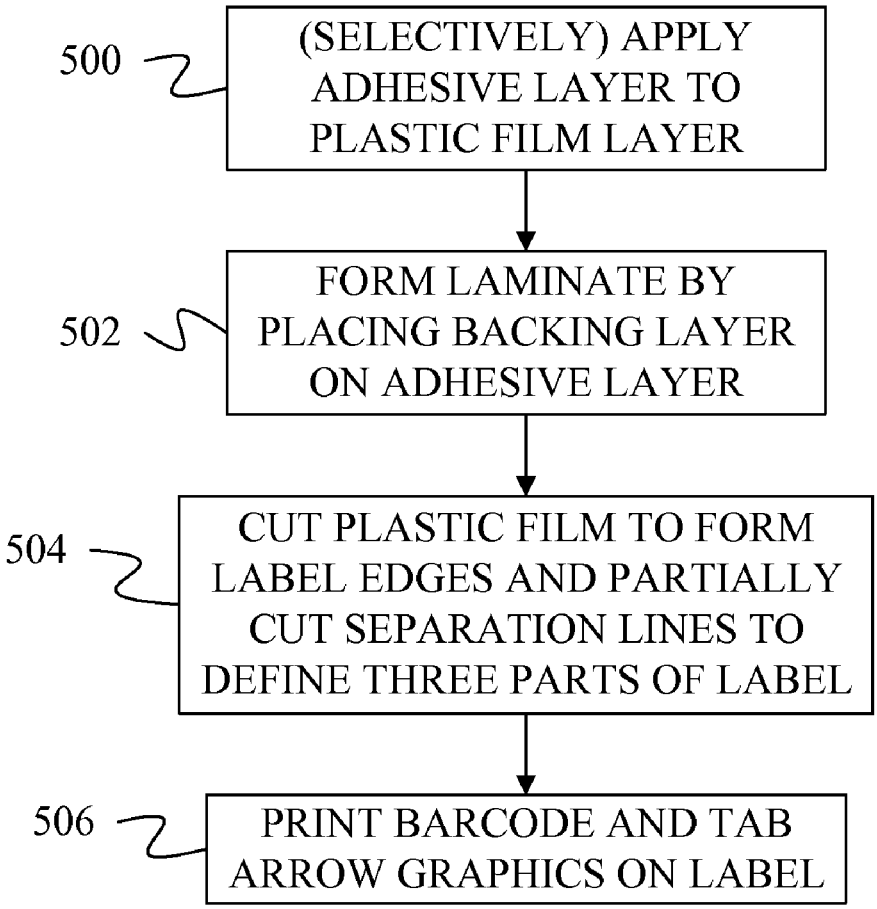
FIG. 5 is a flow diagram of a method of forming the labels of FIG. 3.

FIG. 5 provides a flow diagram of a method of forming labels of the present embodiments. In step 500, adhesive layer 402 is applied to plastic sheet layer 404. Application of adhesive layer 402 can be performed using a roller applicator over which plastic sheet layer 404 moves or can be applied using a printing technique that selectively applies adhesive to only portions of plastic sheet material 404.

At step 502, the laminate is formed by placing backing layer 400 on adhesive layer 402, opposite from plastic sheet layer 404. At step 504, plastic film layer 404 is cut using die cut tools to form the label edges and the separation lines. This cutting step produces labels divided into the three parts or sections discussed above. As noted above, the die-cutting tools can perforate the label, score the label, and/or cut a partial depth of the label to define the separation lines.

At step 506, graphical material is printed on the labels. This graphical material can include barcodes such as barcode 132 and lifting direction indicators such as the tab arrow graphics 134 and 136 described above. Other graphical material may be printed as well such as a product description, price, or manufacturer, for example.

The geometry of label 100 of FIG. 1 makes it easy for users to remove the label from a product such as product 180. For example, in FIG. 6, first section 102 is shown during the process of removing section 102 by pulling tab 112 in a direction 600 that is parallel to separation line 108. This pulling action applies a separating force on section 102 relative to product 180. Pull tab 112 can be gripped easily because recess 120 provides a space for the user to insert their finger and grip tab 112. In addition, the alignment of edge 116 with separation line 108 allows for easy separation of section 102 from section 106 along separation line 108. Similarly, in FIG. 7, section 104 is removed by pulling pull tab 114 in a direction 700 that is parallel to separation line 110 creating a separating force on section 104 relative to product 180 and thereby causing section 104 to separate from section 106 along separation line 110. After sections 102 and 104 have been removed, center section 106 remains as shown in FIG. 8.

Center section 106 can then be removed by scraping section 106 from product 180. Because of the thin width 800 of section 106, this scraping action will tend to destroy section 106 during removal. As a result, it will be very difficult to reconstruct label 100 on another article, thereby forming a barrier to switching labels between products.

Figures 6, 7, 8:
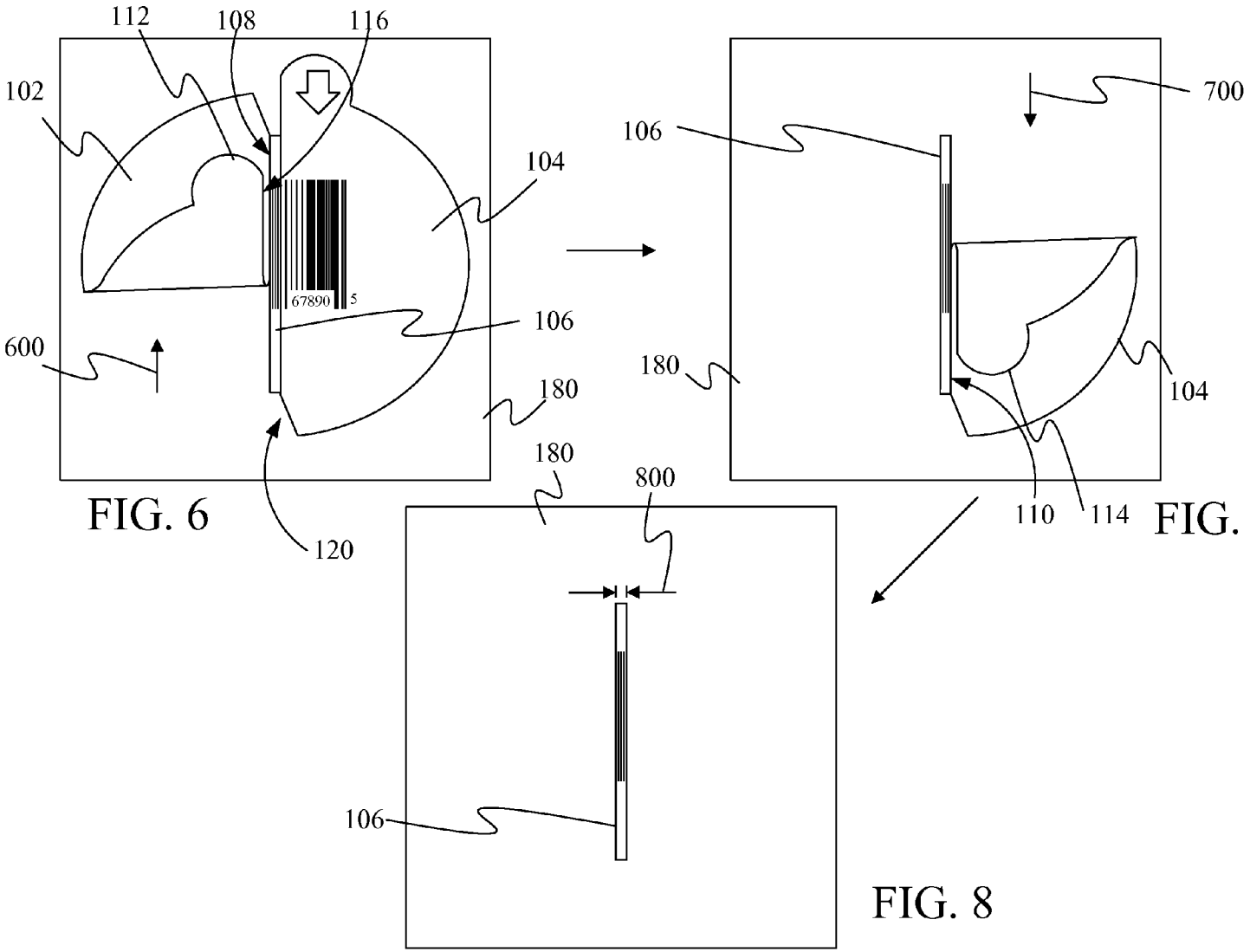
FIG. 6 is a top view of the label and product of FIG. 1 showing a first part of the label being removed.
FIG. 7 is a top view of the label and product of FIG. 1 showing a second part of the label being removed.
FIG. 8 is a top view of the label and product of FIG. 1 after the first and second parts of the label have been removed.

In other embodiments, thin-width section 106 of FIG. 8 can be located on an outer edge of label 100 instead of between sections 102 and 104. In such embodiments, a weakened area extends between the thin-width section and the remainder of the label. The thin-width section still does not contain a pull tab but the other section of the label contains a pull tab. In addition, the thin-width section still contains an entire dark element of the barcode. Under some embodiments, the thin-width section has a width that is less than 2 millimeters. In such embodiments, the remainder of the label other than the thin-width section may consist of a single section with a pull tab or multiple sections, each with pull tabs.

Figure 9:
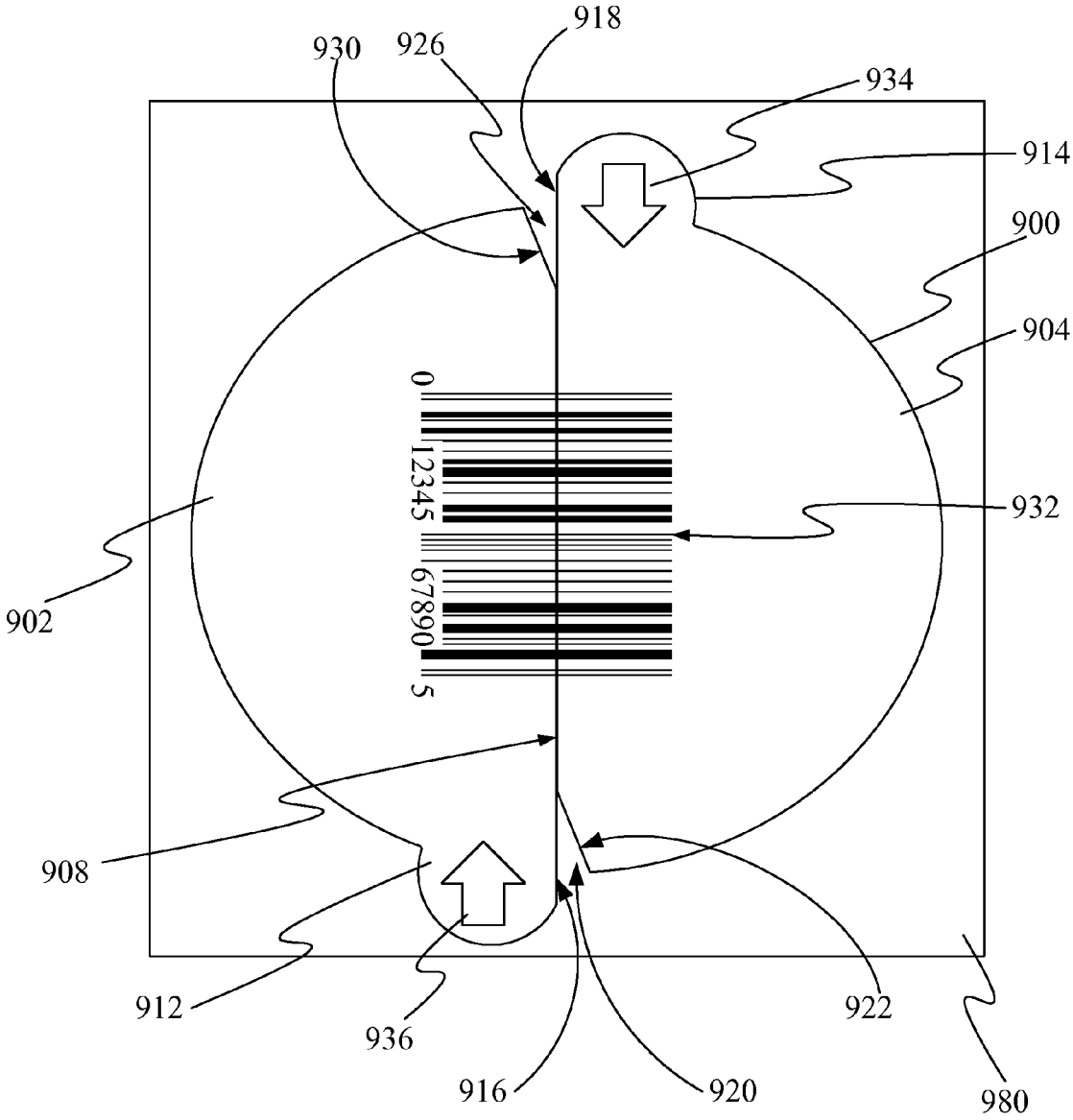
FIG. 9 is a top view of a label under a second embodiment.

FIG. 9 provides a top view of a label 900 under a second embodiment that is applied to a product 980. Label 900 includes a first part or section 902, and a second part or section 904. First part 902 is separated from second part 904 by a weakened area shown as a separation line 908. Separation line 908 can be formed by scoring label 900, cutting a top part of label 900 and/or by perforating label 900. In each of these cases, the separation lines can be said to be partially cut lines.

Although separation line 908 is shown as a straight line in FIG. 9, in other embodiments, line 908 may be curved and/or jagged.

First part 902 of label 900 includes a pull tab or lifting tab 912 and second part 904 includes a pull tab or lifting tab 914. Pull tabs 912 and 914 are gripping pieces that are provided to make it easier for users to grip the label during removal. Under one embodiment, pull tab 912 is defined in part by an edge 916 of label 900 that is aligned with and extends from separation line 908. Similarly, pull tab 914 is partially defined by an edge 918 of label 900 that is aligned with and extends from separation line 908. A recess 920 is defined in label 900 by edge 916, and an edge 922 that defines part of second part 904. Similarly, a recess 926 is defined in label 900 by edge 918 and an edge 930 that defines part of first part 902. Separation line 908 extends from recess 926 to recess 920.

Graphical material, such as barcode graphic 932 and/or arrow graphics 934 and 936, is printed on the top of label 900. Barcode graphic 932 is printed transverse to separation line 908 such that the top part of barcode graphic 932 is printed on second part 904 and the bottom part of barcode graphic 932 is printed on first part 902.

Arrows 934 and 936 provide an indication to a user that pull tabs 912 and 914 should be pulled in a direction that is parallel to separation line 908. If pull tabs 912 and 914 are lifted in such a direction, first part 902 will separate from second part 904 along separation line 908 thereby facilitating quick removal of label 900.

In the embodiment of FIG. 9, first part 902 and second part 904 are formed from an elastic material such as a polyolefin film specially engineered to retain stiffness for dispensability. Under one embodiment, the material is made of Fasson® TransCode® Plus White a polyolefin film manufactured by Avery Dennison Corporation. The elasticity of this material is such that when a user lifts on pull tab 912 or pull tab 914, the material will stretch thereby deforming barcode graphic 932. The deformation of barcode graphic 932 will make it impossible for a barcode reader to read the barcode pattern represented by barcode graphic 932. As a result, if the label parts are later placed on a different product, they will be unreadable.

In other embodiments, barcode graphic 932 may be oriented differently on label 900 as long as the orientation of barcode graphic 932 is such that when pull tab 912 or pull tab 914 is lifted, the spacing between barcode elements changes due to stretching of first part 902 or second part 904.

Although label 100 has been discussed above in connection with being placed on a product, label 100 can be placed on other items such as packaging and price tags, for example.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A label comprising:

a first section formed of a sheet layer having a first pull tab free of adhesive;

a second section formed of the sheet layer having a second pull tab free of adhesive;

a third section between the first section and the second section formed of the sheet layer, wherein a first weakened area is between the third section and the first section and wherein a second weakened area is between the third section and the second section, wherein the first pull tab comprises a first side edge that is aligned with and extends from the first weakened area and the second pull tab comprises a second side edge that is aligned with and extends from the second weakened area and wherein the third section has a narrower width than a width of the first section and is free of a pull tab such that the sheet layer of the third section is damaged when removed and wherein an adhesive layer is applied to the sheet layer of the third section;

a first recess in the label defined by the first side edge of the first pull tab, an exterior edge of the sheet layer of the third section and an edge of the sheet layer of the second section;

a second recess in the label defined by the second side edge of the second pull tab, an exterior edge of the sheet layer of the third section and an edge of the sheet layer of the first section; and a graphic that extends across the first section, the second section, and the third section wherein the graphic comprises a barcode graphic that extends across the third section such that an entirety of a dark element of the barcode graphic is within the third section and such that the barcode graphic will not be read properly without the third section.

2. The label of claim 1 further comprising the adhesive layer applied to the sheet layer of the first section and the second section but not applied to the first pull tab and not applied to the second pull tab.

3. The label of claim 1 wherein the adhesive layer releasably bonds the label to an item such that when a separating force is applied to the first section relative to the item, the first section separates from the third section along the first weakened area, leaving the third section on the item.

4. The label of claim 3 wherein when a separating force is applied to the second section relative to the item, the second section separates from the third section along the second weakened area leaving the third section on the item.

5. The label of claim 1 further comprising a graphic on the first pull tab indicating that the pull tab should be pulled along a direction parallel to the first weakened area.

6. A product having a label, the product comprising:

a first area of the product releasably bonded to a first portion of a sheet layer of the label by an adhesive layer located between the first area of the product and less than the entirety of the first portion of the sheet layer of the label, wherein the first portion of the sheet layer of the label comprises a first gripping piece and wherein the adhesive layer is not located between the first gripping piece and the product;

a second area of the product releasably bonded to a second portion of the sheet layer of the label by an adhesive layer applied to the entirety of the second portion of the sheet layer of the label and directly bonding the second area of the product and the entirety of the second portion of the sheet layer of the label, a border between the first portion and the second portion of the label being defined by a first separation line, wherein the first gripping piece is defined in part by a first edge of the label and wherein the first edge of the label is aligned with and extends from the first separation line; and a third area of the product releasably bonded to a third portion of the sheet layer of the label by an adhesive layer located between the third area of the product and less than the entirety of the third portion of the sheet layer of the label, a border between the second portion and the third portion of the sheet layer of the label being defined by a second separation line, wherein the shortest distance between the first separation line and the second separation line across the second portion is less than 2 millimeters such that the second portion of the sheet layer tends to be destroyed when removed from the product.

7. The product of claim 6 wherein the third portion of the sheet layer of the label comprises a second gripping piece and wherein the adhesive layer is not located between the second gripping piece and the product.

8. The product of claim 7 wherein the second gripping piece is defined in part by a second edge of the label and wherein the second edge is aligned with and extends from the second separation line.

9. A method comprising:

forming a laminate comprising a plastic film layer, an adhesive layer, and a backing layer;

cutting the plastic film layer to form a label having a first part, a second part and a third part, wherein a first partially cut line extends between the first part and the second part and wherein a second partially cut line extends between the second part and the third part, the first part having a lifting tab defined in part by an edge of the label that is aligned with the first partially cut line; and printing graphical material on the plastic film.

10. The method of claim 9 wherein printing graphical material comprises printing a barcode such that the barcode extends across the first part, the second part, and the third part of the plastic film.

11. The method of claim 9 wherein the third part of the plastic film comprises a second lifting tab defined in part by an edge of the label that is aligned with the second partially cut line.

12. The method of claim 9 wherein the edge of the label that defines the lifting tab, an edge of the label that defines a portion of the second part of the plastic film and an edge of the label that defines a portion of the third part of the plastic film define a recess in the label.

13. The method of claim 9 wherein printing graphical material comprises printing an arrow on the lifting tab that points in a direction that is parallel to the first partially cut line.

14. The method of claim 9 wherein the first partially cut line and the second partially cut line are parallel to each other.

15. A label comprising:

a first section of a plastic layer having a first pull tab;

an adhesive layer selectively applied to the first section of the plastic layer such that the first pull tab is free of adhesive;

a second section of the plastic layer without a pull tab, wherein a first weakened area defines a boundary between the second section and the first section and wherein the second section has a width that is less than 2 millimeters wide, the adhesive layer applied to the entirety of the second section of the plastic layer; and a barcode graphic that extends across the first section and the second section such that an entirety of a dark element of the barcode graphic is within the second section and such that the barcode graphic cannot be read without the second section.

16. The label of claim 15 further comprising a third section of the plastic layer having a second pull tab.

17. A label comprising:

a first section having a first pull tab and a second section having a second pull tab, the first section and second section constructed of an elastic material such that pulling on the first pull tab stretches the first section and pulling on the second pull tab stretches the second section;

a barcode graphic extending across both the first section and the second section such that the stretching of the first section resulting from pulling on the first pull tab causes the spacing between elements on the barcode graphic on the first section to change such that the barcode on the first section is unreadable by a barcode reader and such that the stretching of the second section resulting from pulling on the second pull tab causes the spacing between elements on the barcode graphic on the second section to change such that the barcode on the second section is unreadable by a barcode reader.

18. The label of claim 1 wherein:

the first weakened area and the second weakened area extend in parallel from the first recess to the second recess such that the first weakened area and the second weakened area are separated by less than two millimeters;

a first arrow is printed on the first pull tab to provide an indication that the first pull tab should be pulled in a direction that is parallel to the first weakened area; and a second arrow is printed on the second pull tab to provide an indication that the second pull tab should be pulled in a direction that is parallel to the second weakened area.

19. The method of claim 12 wherein:

the third part of the plastic film comprises a second lifting tab defined in part by an edge of the label that is aligned with the second partially cut line;

printing graphical material comprises printing a barcode such that the barcode extends across the first part, the second part, and the third part of the plastic film, printing an arrow on the lifting tab that points in a direction that is parallel to the first partially cut line, and printing an arrow on the second lifting tab that points in a direction that is parallel to the second partially cut line;

the edge of the label defining the second lifting tab, an edge of the second part and an edge of the first part together define a second recess in the label;

the first partially cut line and the second partially cut line extend from the recess to the second recess parallel to each other; and the adhesive layer is missing beneath lifting tab and the second lifting tab.

* * * * *